US007246381B2

(12) United States Patent
Green

(10) Patent No.: US 7,246,381 B2
(45) Date of Patent: Jul. 24, 2007

(54) EXERCISE SUIT

(76) Inventor: Michael D. Green, 1617 Shillingsbridge Rd., Orangeburg, SC (US) 29115

( * ) Notice: Subject to any disclaimer, the term of this patent is extended or adjusted under 35 U.S.C. 154(b) by 279 days.

(21) Appl. No.: 10/666,347

(22) Filed: Sep. 19, 2003

(65) Prior Publication Data

US 2005/0034205 A1 Feb. 17, 2005

Related U.S. Application Data

(60) Provisional application No. 60/412,444, filed on Sep. 20, 2002.

(51) Int. Cl.
*A41D 13/00* (2006.01)

(52) U.S. Cl. ..... 2/69; 482/105

(58) Field of Classification Search ..... 2/102, 2/69, 115, 105, 83, 94, 2.5, 81, 253; 482/74, 482/105, 139

See application file for complete search history.

(56) References Cited

U.S. PATENT DOCUMENTS

| | | | | | |
|---|---|---|---|---|---|
| 1,062,467 | A | * | 5/1913 | Huntzinger | 450/153 |
| 2,470,678 | A | * | 5/1949 | Auslender | 2/105 |
| 2,493,545 | A | * | 1/1950 | Muyleart | 2/70 |
| 4,384,369 | A | | 5/1983 | Prince | |
| 4,407,497 | A | | 10/1983 | Gracie | |
| 4,508,110 | A | * | 4/1985 | Modglin | 602/19 |
| 4,910,802 | A | | 3/1990 | Malloy | |
| 4,989,267 | A | * | 2/1991 | Watson | 2/102 |
| 5,002,270 | A | * | 3/1991 | Shine | 482/105 |
| 5,033,117 | A | | 7/1991 | Fairweather | |
| 5,109,546 | A | | 5/1992 | Dicker | |
| 5,201,074 | A | | 4/1993 | Dicker | |
| 5,570,472 | A | | 11/1996 | Dicker | |
| 5,606,745 | A | | 3/1997 | Gray | |
| 5,659,898 | A | | 8/1997 | Bell, Jr. | |
| 5,699,558 | A | * | 12/1997 | Min | 2/48 |
| 5,708,976 | A | | 1/1998 | Dicker | |
| 5,716,307 | A | * | 2/1998 | Vadher | 482/125 |
| D393,028 | S | | 3/1998 | Robinson et al. | |
| 5,778,452 | A | | 7/1998 | Dicker et al. | |
| 5,810,699 | A | * | 9/1998 | Nadeau | 182/105 |
| 6,176,816 | B1 | * | 1/2001 | Dicker et al. | 482/124 |
| D440,741 | S | | 4/2001 | Veira | |
| 6,282,717 | B1 | * | 9/2001 | Ng | 2/70 |
| 6,749,579 | B1 | * | 6/2004 | Schroder | 602/36 |

* cited by examiner

*Primary Examiner*—Tejash Patel
(74) *Attorney, Agent, or Firm*—Foley & Lardner LLP

(57) ABSTRACT

The disclosed embodiments of exercise garments includes a torso portion adapted to substantially cover the torso of a user and one or more flaps. Each flap is secured substantially to a side of the torso portion. The exercise garment also includes at least one fastener adapted to selectively secure the pair of flaps across at least a portion of an abdominal region of the user. The fasteners may include a hook-and-loop arrangement (such as Velcro7), buttons or snaps. The illustrated embodiment includes a pair of flaps, which may overlap over the abdominal region when both flaps are secured. The fasteners may be adapted to provide adjustable positioning of the flaps. The adjustable positioning includes variable placement of the flaps relative to the abdominal region. The torso portion may also include a corset arrangement extending from a top portion of the torso portion downward through at least a portion of the abdominal region.

9 Claims, 4 Drawing Sheets

EXERCISE SUIT

RELATED APPLICATIONS

This application is related to U.S. Provisional Patent Application No. 60/412,444, filed Sep. 20, 2002, from which priority is claimed, and which is hereby incorporated by reference in its entirety, including all tables, figures, and claims.

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

FIELD OF THE INVENTION

The invention relates generally to clothing. More particularly, the invention provides clothing suitable for wearing during exercising.

BACKGROUND

The following discussion of the background of the invention is merely provided to aid the reader in understanding the invention and is not admitted to describe or constitute prior art to the present invention.

Various devices are known for facilitating improvement of muscles and reduction of fat, particularly in the abdominal regions of the human body. In particular, these devices include many garments to be worn by a user during, for example, exercise activity. For example, reference may be made to the following U.S. patents.

U.S. Pat. No. 4,384,369 discloses an exercise suit which includes a jacket and pants having numerous pockets. The pockets carry bags containing liquid to provide a weight load during movement of the body. To permit automatic adjustment for different body sizes, the sleeves and legs of the suit are longitudinally slit, and an elastic strap draws the opposite edges of each slit toward one another.

U.S. Pat. No. 4,407,497 discloses a weighted exercise suit incorporating two weight strips over the shoulders. Each strip contains compartments which hold weights that can be regulated by the user.

U.S. Pat. No. 4,910,802 discloses an exercise suit apparatus of unitary construction with elastic bands positioned within conduits along the various sides of human appendages. The elastic bands are provided with tensioning devices and effect a level of exercise.

U.S. Pat. No. 5,033,117 discloses a unitary full-body exercise suit having a set of pockets on each thigh portion for receiving weights. Belt loops having straps to support the weights in the pockets are provided between the upper body portion and the lower body portion.

U.S. Pat. No. 5,109,546 discloses an exercise suit having a pair of stretchable pants and a pull-over top. A reinforcement segment is attached to the pants and a reinforcing collar is attached to the top. Leg bands extend around the user's feet and side bands extend down the sides of the top to provide elastic resistance. Related U.S. Pat. No. 5,201,074 discloses exercise short pants with many of the features disclosed in U.S. Pat. No. 5,109,546.

U.S. Pat. Nos. 5,570,472 and 5,708,976 disclose a resistive exercise suit including a shirt and trousers. The shirt and trousers are provided with tension bands and stirrups to provide a resilient snug fit, resulting in resistance to motion of the arms and legs.

U.S. Pat. No. 5,606,745 discloses a resistive exercise suit including a body suit. Resilient ribs are secured to the body suit for biasing various portions of the body to provide resistance against motion.

U.S. Pat. No. 5,659,898 discloses an elastic body suit constructed of two elastic layers. The layers are quilted together over a series of weights and include air ports for cooling of the body.

U.S. Pat. No. 5,778,452 discloses an exercise garment having an outer layer and an inner layer. The outer layer is in the form of a loosely fitting warm-up suit, while the inner layer is made of an elastic resistance material and is secured to the outer layer. The inner layer requires the user to stretch the material during various body movements.

U.S. Design Pat. Nos. D393,028 and D440,741 disclose ornamental designs for exercise suits.

SUMMARY OF THE INVENTION

The disclosed devices are directed to exercise garments. The exercise garments are adapted to facilitate holding in of the stomach and abdominal muscles by the user, thereby providing a smaller and stronger stomach.

In one aspect of the invention, an exercise garment includes a torso portion adapted to substantially cover the torso of a user. The torso portion generally includes a portion of the garment that can be worn over the torso of a user, such as a man or a woman.

The exercise garment also includes one or more flaps. Each flap is secured substantially to a side of the torso portion. A flap is a generally flat section of material that has at least one free end. The side of the torso portion is that portion of the suit which, when worn by a user, extends down the sides of the user, for example, from the arm pits to the hips.

The exercise garment also includes at least one fastener adapted to selectively secure the pair of flaps across at least a portion of an abdominal region of said user.

A fastener is a means for at least temporarily securing a component in a fixed position relative to another component. Examples of fasteners include, without limitation, Velcro7 strips, buttons and snaps.

An abdominal region of a user is the region of the human body including the upper and lower abdominal muscles and the stomach.

In a preferred embodiment, the exercise garment includes a pair of flaps. In a further preferred embodiment, the pair of flaps overlap over the abdominal region when both flaps are secured.

In a preferred embodiment, the fastener includes a hook-and-loop arrangement. The hook-and-loop arrangement may include strips of hooks mounted on one component and a corresponding strip of loops mounted on another component. In a further preferred embodiment the hook-and-loop arrangement is adapted to provide adjustable positioning of the flaps. The adjustable positioning includes variable placement of the flaps relative to the abdominal region.

In a preferred embodiment, the torso portion includes a corset arrangement extending from a top portion of the torso portion downward through at least a portion of the abdominal region. A corset arrangement is a set of crisscrossing ties.

In a preferred embodiment, the torso portion includes a crew neck. A crew neck is an opening near the top of a garment which, when the garment is worn, exposes at least a portion of the wearer's neck.

In a preferred embodiment, the torso portion includes sleeves. In an alternate embodiment, the torso portion is sleeveless.

In a preferred embodiment, the torso portion includes a plurality of pockets adapted to retain a weight. A weight is any component having a mass and is preferably made of a relatively high-density material.

In a preferred embodiment, the exercise garment further includes a leg portion adapted to cover at least a portion of each leg of the user. The leg portion and the torso portion are preferably integrally formed. Integrally formed includes a unitary construction from, for example, a single continuous piece of material.

In another aspect of the invention, An exercise garment includes an integral body suit adapted to substantially cover at least a portion of a torso of a user. In this context, "integral" generally refers to a single-piece construction. A body suit is a portion of a garment adapted to fit a user in substantially a form-fitting manner.

A pair of flaps are attached to opposing sides of a waist portion of the body suit, each of the flaps having a free end. The waist portion is that portion of the body suit which, when worn by a user, covers the waist region of the user. Generally, the waist region may extend from below the arm pits to just above the hips. A free end is an unsecured end of a flap.

The exercise garment further includes fastening means for selectively securing the free end of each of the pair of flaps across at least a portion of an abdominal region of the user.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

Figure 1:
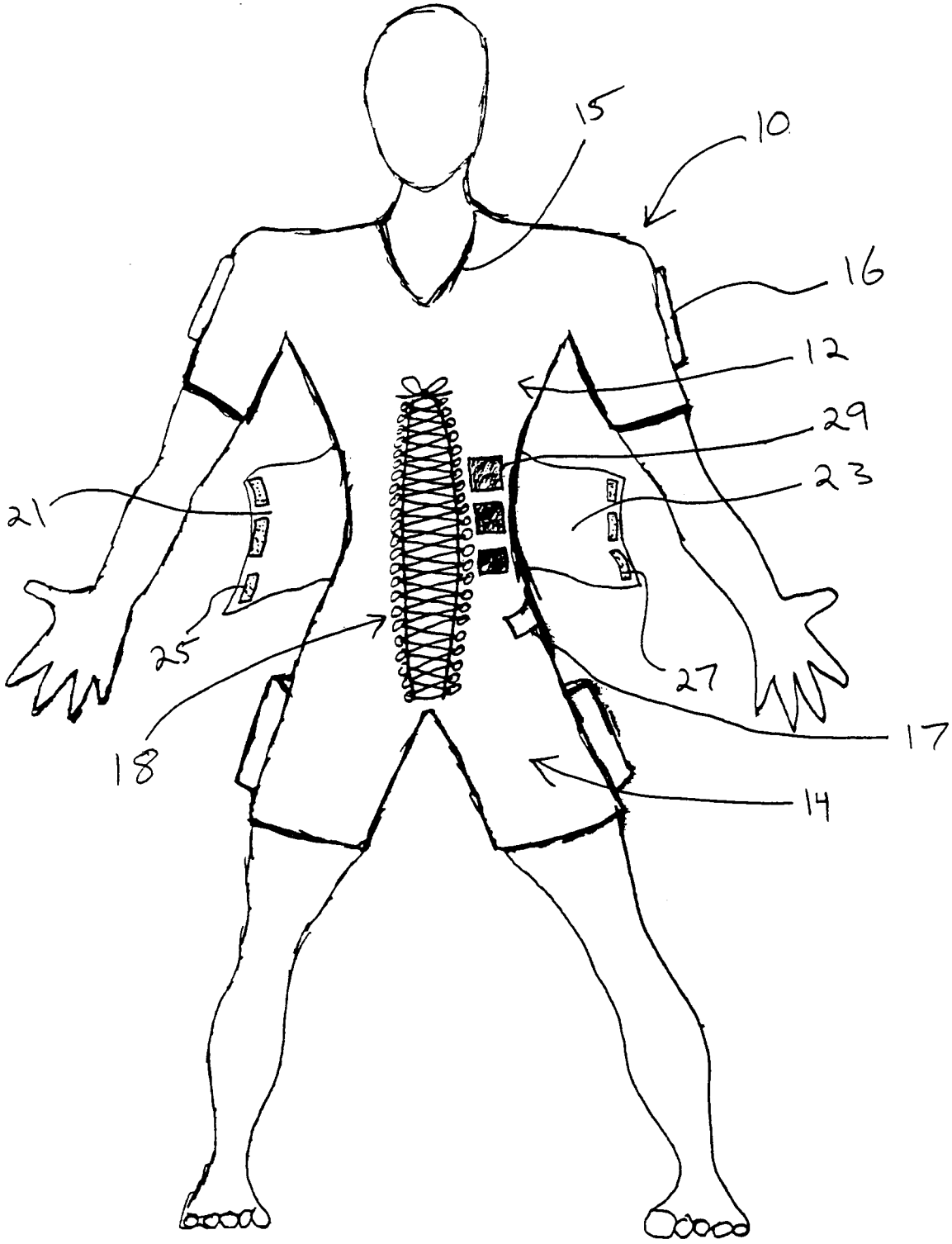
FIG. 1 illustrates an embodiment of an exercise suit according to the present invention, worn by a user.
Figure 2:
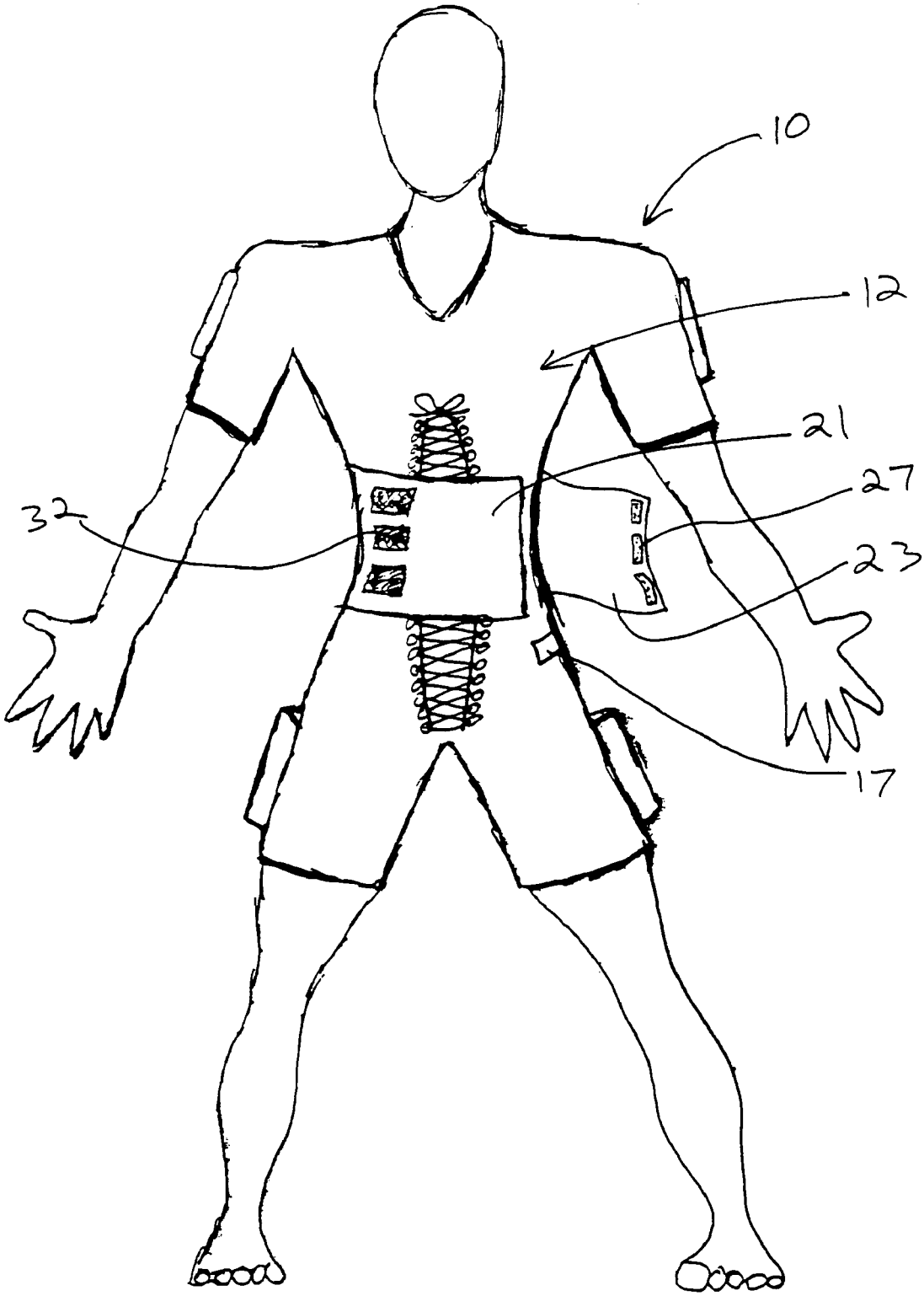
FIG. 2 illustrates the exercise suit of FIG. 1 with one of the two flaps being secured.
Figure 3:
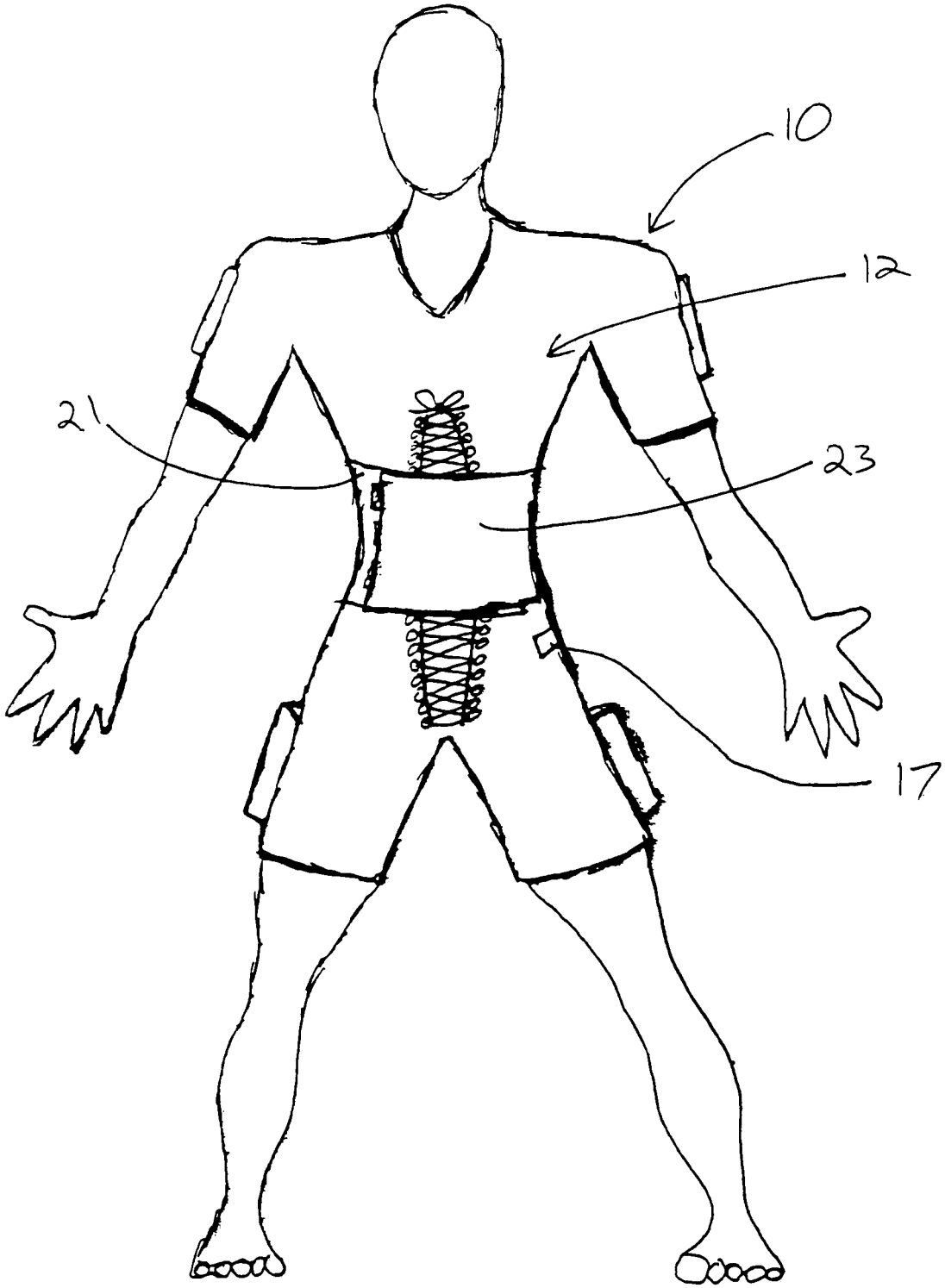
FIG. 3 illustrates the exercise suit of FIGS. 1 and 2 with both flaps completely secured.

FIGS. 1-3 illustrate a user wearing an embodiment of an exercise suit according to an embodiment of the present invention. The illustrated exercise suit 10 includes a torso portion 12 adapted to substantially cover the torso of the user and a leg portion 14 adapted to cover the thigh region. The leg portion 14 and the torso portion 12 may be integrally formed to provide a unitary construction. The exercise suit 10 may be formed of any of a variety of materials including nylon and non-fibrous rubbers such as neoprene. The materials may be selected to increase perspiration, resulting in expulsion of impurities from the body through the pores.

In the illustrated embodiment, the torso portion 12 includes a crew neck 15. The crew neck 15 provides the user with ventilation during exercising activity and may prevent dangerous over-heating. Although the crew neck 15 is preferred, other neck configurations will be apparent to those of ordinary skill in the art.

The torso portion 12 of the embodiment illustrated in FIGS. 1-3 includes short sleeves. The length of the sleeves may be chosen for appropriate function and/or style.

The torso portion 12 and the leg portion 14 are provided with a plurality of pockets, such as pocket 16. The pockets are adapted to hold therein a removable weight to facilitate exercise activities. The weights provide additional resistance for development of muscles. The pockets may be strategically located to isolate improvement of particular muscles or muscle groups.

An accessory strap 17 is provided on one side of the exercise suit 10 for securely retaining an accessory such as a tape or compact disc player. In one embodiment, the strap is approximately 1.5 inches in length and has a width of approximately 2 inches. Thus, a user may secure an audio player to the suit during exercise. The audio player may be used to listen to motivational recordings, such as affirmations previously recorded by the user. Such affirmations should be recorded in the user's own voice and may be a series of positive declarations which may be used as an oath. The affirmations may include such statements as:

a. "I love myself."
b. "I am a beautiful person inside and out."
c. "Everyone has opinions, but I believe in the positive things I say to myself, about myself, because I believe in me."
d. "My courage and confidence give me the determination to achieve my weight loss goals."
e. "I will eat only the appropriate amounts of food. 'Less food on my plate, less food on my fork' at meal times. No one is allowed to discourage or influence me in a negative way."
f. "I am the person who is in control of my success. It is up to me to reach my goals."
g. "I have set weight loss goals for my own personal reasons: My life, my future and my own personal well being."
h. "Weight control and appetite control is easy to handle for me now. I take the time to enjoy my meals; smaller portions and smaller bites which gives ma a slower, healthier and more relaxed way of eating."
i. "I love exercising in my Heat Resistance Suit everyday no matter what form of exercise I choose to do."
j. "I am a very healthy person. I have achieved my weight loss goal of _____ pounds while using my Heat Resistance Suit."
k. "I weigh _____ pounds! I am a size _____, and my measurements are _____."
l. "I have accomplished my goals by exercising in my Heat Resistance Suit."
m. "I love the person I see staring back at me in the mirror."
n. "I am fit, trim and I love me!"

8 2002 Michael Green.

A corset arrangement 18 is provided in the front of the exercise suit 10 extending substantially down the length of the torso portion 12. The corset arrangement allows a user to ensure a tight fit of the exercise suit 10, particularly in the waist region. In the illustrated embodiment, the corset arrangement includes criss-crossing ties extending substantially from the sternum to the lower pelvic area of the user. To facilitate donning of the exercise suit 10, a zipper (not shown) may be provided in the back of the exercise suit.

A pair of flaps 21, 23 are attached to the torso portion 12. The flaps 21, 23 may be made of the same material as the torso portion 12 and the leg portion 14. Each flap 21, 23 is generally rectangular in shape and has a width that extends from just above the hips to a lower part of the chest. Generally, the width is sized to substantially cover the height of the abdominal region, as will be described below. The flaps 21, 23 are attached to the torso portion 12 at the left and right sides of the waist. In the illustrated embodiment, the length of each flap 21, 23 is adapted to extend from the sides of the waist to approximately three-quarters of the way across the abdominal region.

Although the illustrated embodiment includes two flaps 21, 23, it will be understood by those skilled in the art that a different number of flaps may also be provided.

A fastener arrangement is provided to secure the flaps across the abdominal region. In the illustrated embodiment, the fastener arrangement includes Velcro7. In this regard, as most clearly seen in FIG. 1, a set of strips of Velcro7 hooks 25, 27 are provided near the free end of each flap 21, 23. Additionally, a set of strips of Velcro7 loops 29 is provided to correspond with the Velcro7 hooks 25 on one of the flaps 21. The length of the strips of loops 29 generally corresponds with the length of the hooks 25. On the other hand, the width of the loops 29 is made substantially larger than that of the hooks 25 to allow adjustability of the fit of the flaps.

FIGS. 2 and 3 illustrate the fastening of the flaps 21, 23 to the torso portion 12 of the exercise suit 10. First, the set of strips of Velcro7 loops 29 (FIG. 1) on the torso portion 12 are engaged by the Velcro7 hooks near the free end of the flap 21. In this regard, the flap 21 is pulled across the abdominal region of the user, and the fit is adjusted to sufficiently hold in the upper and lower abdominal muscles.

The flap 21 is provided with a set of strips of Velcro7 loops 32 to correspond with the Velcro7 hooks 27 on the other flap 23. Again, the width of the loops 32 is made substantially larger than that of the hooks 27 to allow adjustability of the fit of the flaps. Finally, as illustrated in FIG. 3, the flap 23 is stretched across the abdominal region and secured in place by the engagement of the hooks 27 and the loops 32.

It will be understood by those skilled in the art that the positioning of the hooks and loops may be reversed. Thus, the free ends of the flaps may be provided with strips of loops, while corresponding hooks are provided to secure the free ends in place. Further, other fasteners may be used as well. For example, the Velcro7 strips may be replaced by buttons, snaps or other well-known fasteners.

Thus, the disclosed embodiments of the suit cause a user to hold in his or her stomach. Holding the muscles in the same position during exercise facilitates tightening of the muscles, which in turn decreases food intake and ultimately results in a smaller stomach and a healthier body.

Figure 4:
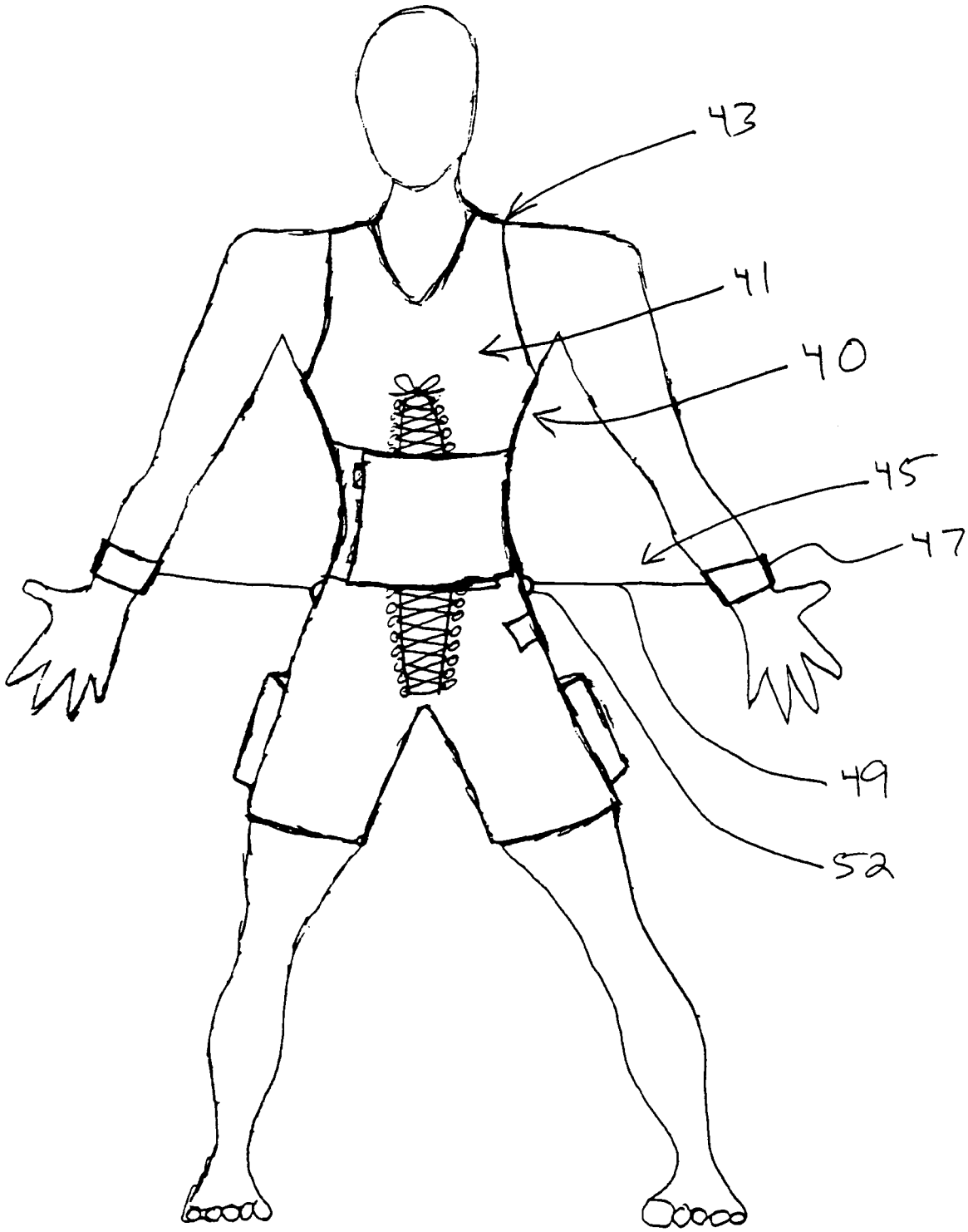
FIG. 4 illustrates another embodiment of an exercise suit according to the present invention.

Another embodiment of an exercise suit is illustrated in FIG. 4. The exercise suit 40 illustrated in FIG. 4 is similar to that described above with reference to FIGS. 1-3 in that the exercise suit 40 includes a torso portion 41, a corset arrangement and flaps. The embodiment illustrated in FIG. 4 is provided with a pair of sleeveless straps 43 adapted to be worn over a user's shoulders. The sleeveless aspect may further prevent over-heating of the user's body by provided increased ventilation.

The embodiment illustrated in FIG. 4 further includes a resistance assembly 45 to facilitate exercise activity. The resistance assembly 45 includes a pair of wrist straps 47 adapted to be worn on a user's wrists. The wrist straps 47 may be adjustable to fit a variety of users. Resilient ties 49 extend from each wrist strap 47 to an attachment loop 52 provided near the hip region of the exercise suit 40. The resilient ties 49 may include elastic to provide resistance for movement of the arms during certain exercise activities. In this regard, the exercise suit 40 provides a tool for muscle development through resistance.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

What is claimed is:

1. An exercise garment, comprising:

a torso portion adapted to substantially cover the torso of a user;

a manually adjustable tension control element, said tension control element being located in the front of said exercise garment and extending from the upper abdominal region to the lower abdominal region of said user;

wherein said tension control element comprises a comet arrangement extending from a top portion of said torso portion downward through at least a portion of said abdominal region;

a pair of flaps, each flap being secured substantially to a side of said torso portion; and at least one fastener adapted to selectively secure said pair of flaps across at least a portion of an abdominal region of said user; and leg portion adapted to cover at least a portion of each leg of said user, wherein the leg portion includes a plurality of pockets adapted to retain a weight.

2. The exercise garment according to claim 1, wherein said pair of flaps overlap over said abdominal region when both flaps are secured.

3. The exercise garment according to claim 1, wherein said at least one fastener includes a hook-and-loop arrangement.

4. The exercise garment according to claim 3, wherein said hook-and-loop arrangement is adapted to provide adjustable positioning of said flaps.

5. The exercise garment according to claim 1, wherein said torso portion includes a plurality of pockets adapted to retain a weight.

6. The exercise garment according to claim 1, wherein said torso portion is formed of a non-fibrous rubber.

7. The exercise garment according to claim 1, further comprising an accessory strap adapted to secure an accessory to said torso portion.

8. The exercise garment according to claim 7, wherein an audio player is secured to said accessory strap, said audio player adapted to play a recording.

9. The exercise garment according to claim 8, wherein said recording includes affirmation recorded in a user's voice.

* * * * *